United States Patent [19]

Antonious

[11] 4,282,657

[45] Aug. 11, 1981

[54] HEEL RESTRAINT WITH AN ADJUSTABLE AND FLEXIBLE CLOSURE ASSEMBLY FOR SHOES

[76] Inventor: Anthony J. Antonious, 205 E. Joppa Rd., Towson, Md. 21204

[21] Appl. No.: 20,990

[22] Filed: Mar. 16, 1979

[51] Int. Cl.[3] ..... A43B 11/00; A43B 5/00

[52] U.S. Cl. ..... 36/50; 36/114; 36/129; 2/DIG. 6; 24/306

[58] Field of Search ..... 36/50, 51, 54, 58.5, 36/129, 114; 2/DIG. 6; 24/204, 73 GC

[56] References Cited

U.S. PATENT DOCUMENTS

| | | | |
|---|---|---|---|
| 2,773,316 | 12/1956 | Clappier | 36/129 X |
| 2,935,798 | 5/1960 | Piberhofer | 36/58.5 X |
| 3,327,410 | 6/1967 | Park, Sr. et al. | 36/50 |
| 3,464,125 | 9/1969 | Conway | 36/58.5 X |

FOREIGN PATENT DOCUMENTS

| | | | |
|---|---|---|---|
| 1452 | of 1927 | Australia | 36/50 |
| 430494 | 8/1967 | Switzerland | 36/50 |

OTHER PUBLICATIONS

Velcro D-Ring, Velcro Corp. Inc., Approx. Date 1962.

*Primary Examiner*—James Kee Chi

*Attorney, Agent, or Firm*—Nicholas J. Aquilino

[57] ABSTRACT

A shoe having a heel restraint secured by an adjustable and flexible closure assembly utilizing separable fastening members having coacting, flexible gripping elements, such as hook and loop fastening means and operating separately from the fastening means to fasten the shoe. The closure assembly includes an anchor strap having an opening adapted to receive a fastener strap which makes it easy to adjust for and maintain the precise tension desired at the wearer's heel by providing a sturdy, adjustable heel restraint and stabilizer to independently control the tension on the heel section of the shoe.

31 Claims, 31 Drawing Figures

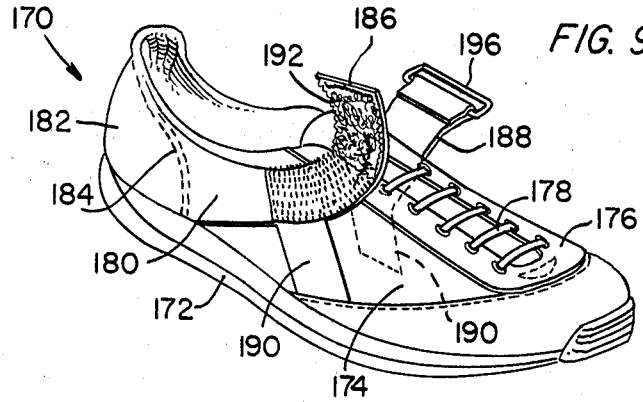
FIG. 9.
FIG. 10
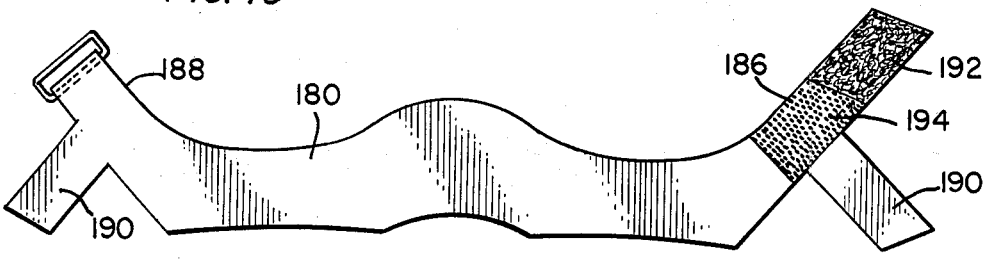
FIG. 11.
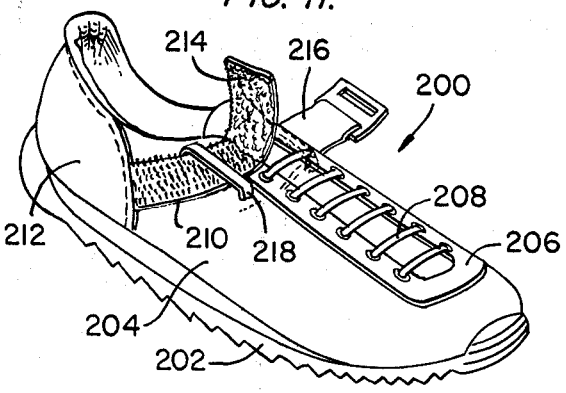
FIG. 12.
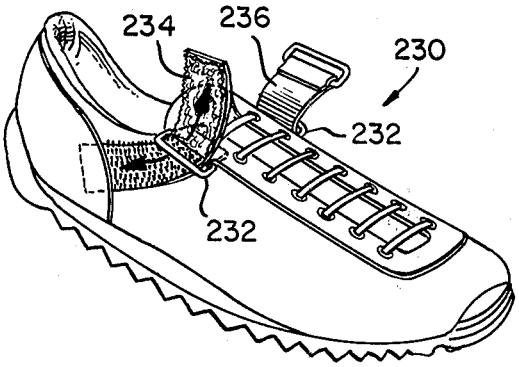
FIG. 13.
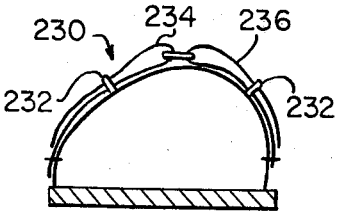
FIG. 15.
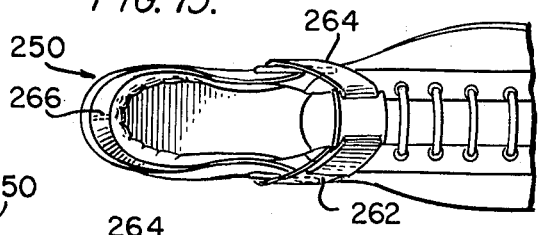
FIG. 14.
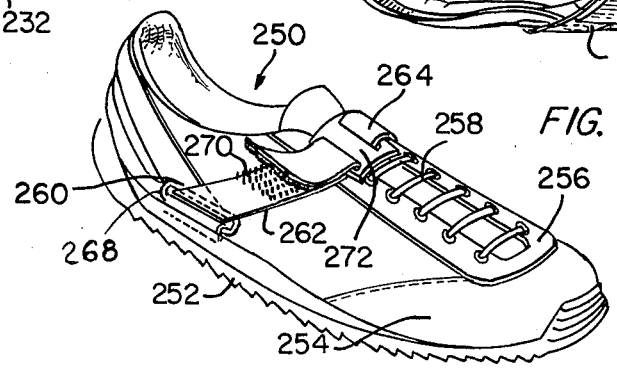
FIG. 16.
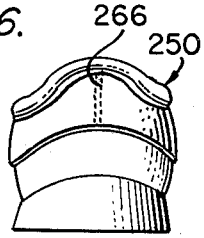

HEEL RESTRAINT WITH AN ADJUSTABLE AND FLEXIBLE CLOSURE ASSEMBLY FOR SHOES

BACKGROUND AND DESCRIPTION OF THE INVENTION

The present invention pertains to shoes, particularly sport shoes, such as running, track, basketball, football, baseball, tennis, golf, biking and various other sports. The invention can further be adapted for use with boots, specialized shoes and other footwear.

Sport shoes which are currently commercially available use laces to obtain additional tautness or tension at the wearer's heel. Laces will yield or loosen when a force is applied against them, therefore, they do not maintain the original tautness applied by the wearer.

In my prior U.S. Pat. Nos. 4,079,527 and 4,126,951 and other copending applications, I disclose various Velcro-type closure assemblies for fastening shoes. Other patents showing similar fasteners on shoes are Canadian Pat. No. 935,640 to Lurien, U.S. Pat. Nos. 3,626,610 to Dassler, 3,618,325 to Cary and 4,081,916 to Salisburg, among others. However, the shoes utilizing Velcro-type closures referred to above are not constructed to function in combination with an independently controlled heel restraint utilizing an adjustable and flexible closure assembly, as herein described.

The present invention relates to improvements in footwear, particularly, shoes used in fast-action sports. The shoe structure includes an independently controlled heel restraint which provides an additional built-in safeguard for improved comfort and overall protection to the wearer's foot. Specifically, this invention refers to an improved heel restraint and stabilizer utilizing an adjustable and flexible closure assembly which offers the advantage of a customized fit, more support, and protection for the wearer's heel, and an easily closed and released fastener to maintain the precise desired tautness and firmness of the shoe while providing maximum comfort. This arrangement is equally applicable whether the wearer has a wide, medium or narrow heel or a high, medium or low instep. The closure assembly of this invention is applicable to shoes made of flexible, light-weight material, such as canvas, soft leather, nylon and the like, for shoes made for various fast-action sports. It is also applicable to shoes made of more durable and rigid material, such as leather, vinyl and the like, for various outdoor activities.

Quite different from the prior art shoes which use laces that will loosen during use when there is an exertion or force in the shoe, the shoe utilizing the closure assembly of the present invention maintains the original tautness with no slackening or loosening. This is accomplished because of the sturdy construction of the shoe and closure assembly and the Velcro-type hook and loop fastening material used therewith.

The heel restraint closure assembly surrounds and embraces the rear portion of the shoe, specifically at the heel and the instep area so that the wearer's foot is held considerably firmer than with laces thereby providing and maintaining the necessary tautness and strength required, particularly in fast-action sports. More importantly, the substantial bracing and supporting action of the heel restraint closure assembly helps to keep the foot bones, tendons and ligaments in their strongest position for maximum protection, especially during the quick movements required in fast-action sports or long grueling encounters, such as long-distance running.

This invention provides a shoe which minimizes injury while maximizing safety and comfort.

The shoes of the present invention have uppers with a heel restraint which can be a single member extending around the heel or shoe counter. Alternately, an independently controlled heel restraint may be used on each side of the shoe. Additionally, elastic means may be included in the heel restraint member of closure assembly to provide increased flexibility.

The improvement of this invention permits the wearer to independently control the precise tension desired at the heel or shoe counter to help minimize the occurrence of sudden contraction and stretching of the muscles and tendons associated with the heel. Further, the heel restraint closure assembly will provide optimum heel fit which will substantially eliminate shifting and rolling of the heel in the shoe which has been shown to be a major cause of foot discomfort and injury.

The heel restraint utilizes an adjustable and flexible closure assembly including an anchor means having an opening which engages a fastener strap including a coacting hook and loop fastening means.

Among the objects of the present invention are the provision of a shoe having a heel restraint using an adjustable and flexible closure assembly which offers more built-in safeguards, minimizes foot discomfort, secures more firmly to the foot, provides a custom fit and optimum comfort to the wearer.

BRIEF DESCRIPTION OF THE DRAWINGS

FIG. 9 is a perspective view of the sixth embodiment of the present invention.

FIG. 10 is a view of a detail of FIG. 9.

FIG. 11 is a perspective view of a seventh embodiment of the present invention.

FIG. 12 is a perspective view of an eighth embodiment of the present invention.

FIG. 13 is a side sectional view of the shoe of FIG. 12.

FIG. 14 is a perspective view of a ninth embodiment of the present invention.

FIG. 15 is a partial plan view of FIG. 14.

FIG. 16 is a rear elevational view of FIG. 14.

DESCRIPTION OF THE PREFERRED EMBODIMENTS

Figure 1:
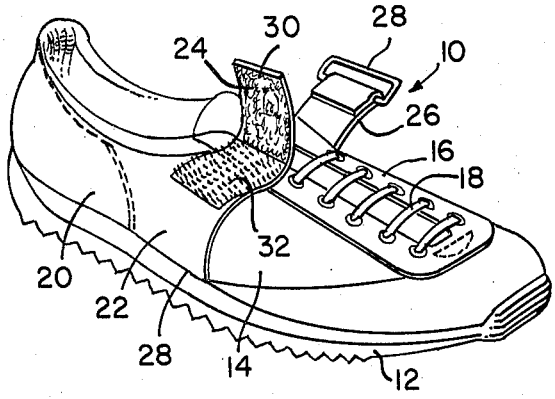
FIG. 1 is a perspective view of a first embodiment of the shoe of the present invention.
Figure 2:
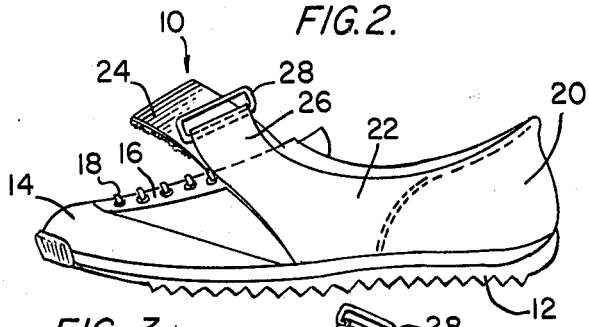
FIG. 2 is a side elevational view of the shoe of FIG. 1.
Figure 3:
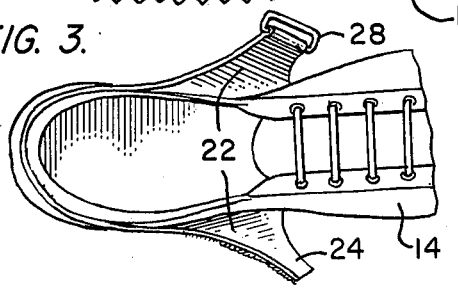
FIG. 3 is a partial plan view of the shoe of FIG. 1.

FIGS. 1, 2 and 3 show a first embodiment of a running-type shoe 10 having a sole 12, uppers 14 and a U-throat vamp 16 forming a variable instep opening secured by laces 18. The back portion of the shoe 10 includes a heel counter area 20 which provides rigidity and support in the heel area. A heel restraint 22 surrounds the heel-counter area 20 and includes an adjustable and flexible closure assembly. The flexible and adjustable closure assembly utilizes a flexible, multi-adjustable, separable fastener having first and second fastening members including an array of complementary, coacting, flexible gripping elements on each of the members, for example, such as Velcro-type hook and loop separable fasteners. The restraint 22 is formed of a flexible member extending around the back portion of the shoe and is attached to the heel-counter area 20 by stitching or the like. The forward and upper portion of the restraint 22 is free and is elongated to form a fastener strap 24 on one side of the shoe and an anchor strap 26 on the opposite side of the shoe. The lower part 28 of the free end of the restraint 22 is attached to the seam formed by the shoe uppers 14 and the sole 12 in order to provide a vertical stabilizer at this point. The free end of the anchor strap 26 is provided with an opening in the form of a D-ring 28 which is adapted to receive the free end of the fastener strap 24 to secure the heel-restraint closure assembly 22. The fastener strap 24 utilizes a Velcro-type hook and loop fastening means including a pad 30 of loop fastening material and a pad 32 of hook fastening material.

Figure 4:
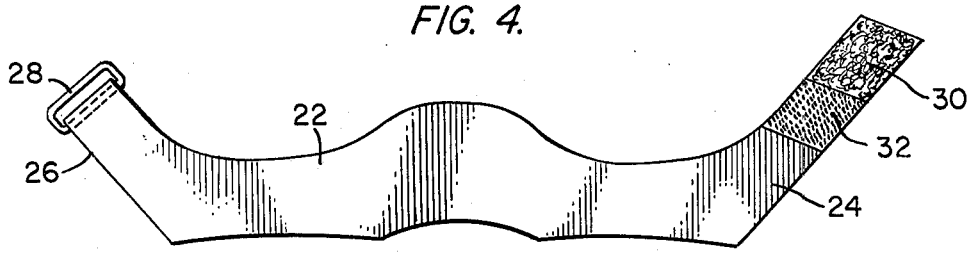
FIG. 4 is a view of a detail of the shoe of FIG. 1.

FIG. 4 shows the heel restraint 22 in a flat position before it is attached to a shoe which more clearly illustrates its one-piece construction.

In use, the wearer inserts his foot into the shoe and it is laced in a conventional manner. The fastener strap 24 is then threaded through the D-ring 28 and pulled until the exact desired tautness is achieved in the heel area by the tension of the heel restraint 22 on the heel-counter area 20. When this is achieved, the fastener strap 24 is folded back upon itself securing the coacting hook and loop fastener pads 30 and 32. Not only does the closure assembly provide and maintain tension in the heel area, it also provides support at the instep since it spans the top portion of the variable instep opening above the laces 18.

Figure 5:
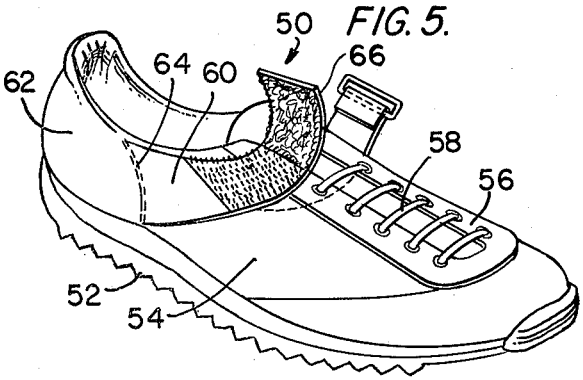
FIG. 5 is a perspective view of a second embodiment of the present invention.

FIG. 5 shows a second embodiment of a running shoe 50 of the present invention which is essentially the same as the shoe shown in FIGS. 1, 2 and 3 including a sole 52, uppers 54, U-throat vamp 56 forming a variable instep opening, laces 58 and a heel restraint 60. In this embodiment, the restraint is attached only to a heel-counter cover 62 at the stitch line 64 and the rest of the restraint 60 is free. Unlike the shoe in FIGS. 1, 2 and 3, the heel restraint is not vertically stabilized where the sole and uppers meet. The free end of the heel restraint 60 provides an adjustable and flexible closure assembly including a fastener strap 66, on one side of the shoe 50, utilizing a Velcro-type hook and loop fastening means and an anchor strap 68 having a D-ring opening on the other side of the shoe 50 which is secured in the same manner as described with respect to FIGS. 1, 2 and 3. In this embodiment, the forces acting upon the heel-counter area are horizontal with respect to the axis of the shoe.

Figure 6:
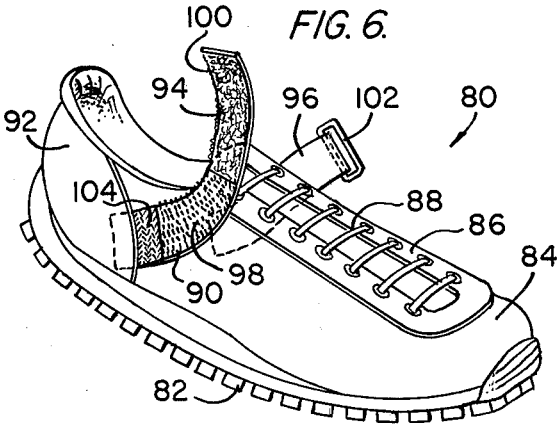
FIG. 6 is a perspective view of a third embodiment of the present invention.

FIG. 6 illustrates a shoe 80 which is also the same type of shoe shown in FIGS. 1, 2 and 3 including a sole 82, uppers 84, U-throat vamp 86 forming a variable instep opening and laces 88. In this embodiment, the structure of the restraint 90 is formed by straps on each side of the shoe connected directly to the heel-counter cover 92. The strap on one side of the shoe forms a fastener strap 94 whereas the strap on the opposite side of the shoe is an anchor strap 96. The fastener strap utilizes a hook and loop fastening means including a pad 98 of hook fastening material and a pad 100 of loop fastening material. The anchor strap is formed with a D-ring 102 which forms an opening through which the fastener strap is connected. The fastener strap 94 includes a section 104 of elastic to provide flexibility at this point after the closure assembly is secured. The shoe is secured in the same way as described with reference to FIGS. 1, 2 and 3 using the laces and the heel restraint closure assembly.

Figure 7:
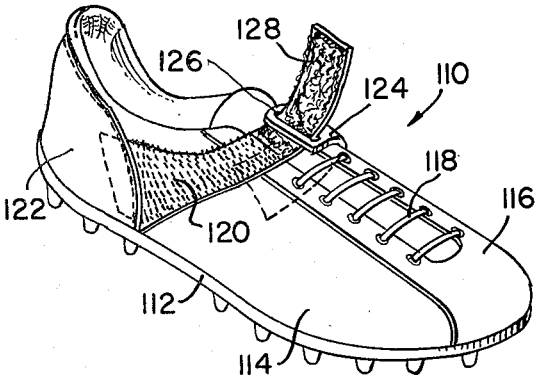
FIG. 7 is a perspective view of a fourth embodiment of the present invention.

FIG. 7 shows another embodiment of a shoe 110 which is essentially the same as the shoe shown in FIG. 5 including a sole 112, uppers 114, U-throat vamp 116 with laces 118 and a heel restraint 120 connected to the heel-counter cover 122. The anchor strap 124 includes a grommet 126 forming an opening which receives a fastener strap 128 utilizing a hook and loop fastening means.

Figure 8:
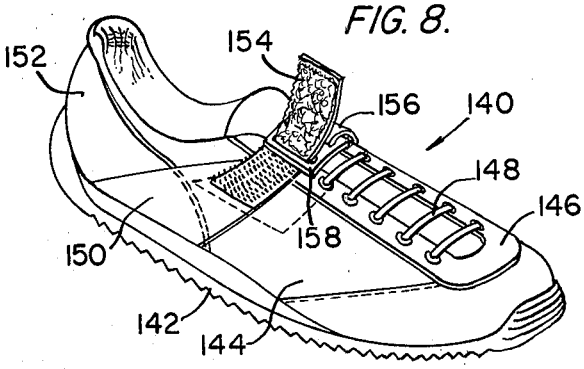
FIG. 8 is a perspective view of the fifth embodiment of the present invention.

FIG. 8 shows still another embodiment of a shoe 140 of the present invention including a sole 142, uppers 144, U-throat 146 forming a variable instep opening and laces 148. A heel restraint 150 is formed of straps on each side of the shoe 140 which are secured to the heel area of the shoe by attaching it at the point where the sole 142 and the heel-counter cover 152 are attached. The restraint straps 150 overlay the heel-counter cover 152 on each side of the shoe 140. The restraint 150 on one side of the shoe 140 forms a fastener strap 154 utilizing a Velcro-type hook and loop fastening means. The restraint (not shown) on the other side of the shoe forms an anchor strap 156 provided with a connector plate 158 having an opening which receives the fastener strap 154 to secure the closure assembly in the same manner as described with respect to the embodiments hereinabove.

FIG. 9 shows still another embodiment of a shoe 170 of the present invention including a sole 172, uppers 174, U-throat vamp 176 and laces 178. The shoe is provided with a heel restraint 180 positioned over the heel-counter area 182 and secured at the stitch line 184. The restraint 180 is elongated on either side of the shoe 170 forming a fastener strap 186 and anchor strap 188, respectively. In this embodiment, the fastener strap 186 and the anchor strap 188 are each provided with a vertical stabilizer 190 connected into the shoe uppers 174 toward the front portion of the shoe 170. The stabilizer 190 maintains the heel restraint 180 in its proper position. The fastener strap utilizes a Velcro-type hook and loop fastening means including a pad 192 of loop fastening material and a pad 194 of hook fastening material. The anchor strap includes a D-ring 196 to secure the closure assembly as hereinabove described.

FIG. 10 shows the restraint 180 of the shoe 170 of FIG. 9 before it is attached to the shoe in a folded out condition clearly showing the relationship of the stabilizers 190 relative to the respective fastener straps 186 and anchor strap 188.

FIG. 11 illustrates yet another embodiment of a shoe 200 of the present invention including a sole 202, uppers 204, U-throat vamp 206 forming a variable instep opening and laces 208. Heel restraint 210 includes straps on either side of the shoe connected directly to the heel-counter cover 212 and forms a fastener strap 214 on one side of the shoe and an anchor strap 216 on the opposite side of the shoe. The restraint straps are maintained in their proper position using a loop 218 of flexible shoe material attached to the uppers 204 adjacent the opening on each side of the shoe. The same type closure assembly described hereinabove is used in this embodiment to secure the shoe.

FIG. 12 illustrates an embodiment of a shoe 230 which is essentially the same as the shoe shown in FIG. 11 with the D-rings 232 used in place of fabric loops adjacent the variable instep opening to maintain the fastener strap 234 and anchor strap 236 in place. In this embodiment, the fastener strap 234 is formed utilizing elasticized hook and loop material to further increase flexibility of the closure assembly during use.

FIG. 13 shows a side sectional view of the shoe 230 showing the relationship of the D-rings 232 to the fastener strap 234 and anchor strap 236.

FIGS. 14, 15 and 16 show another embodiment of a shoe 250 of the present invention including a sole 252, uppers 254, U-throat vamp 256 forming a variable instep opening and laces 258. In this embodiment, the heel restraint 260 is formed of a pair of straps, one strap on each side of the shoe forming a fastener strap 262 and a second strap on the opposite side of the shoe forming an anchor strap 264. Both straps 262 and 264 are free except for fixed ends secured at the back 266 of the shoe 250, as shown in FIG. 16. The straps 262 and 264 are positioned downwardly from the back 266 of the shoe towards the sole 252 where they thread through a D-ring 268 on each side of the shoe 250 which is mounted at the point where the sole 252 and uppers 254 adjoin. The straps then pass upwardly from the D-rings 268 to span the upper portion of the variable instep opening. The closure assembly is the same type as described hereinabove and includes a Velcro-type hook and loop fastening means 270 on the fastener strap 262 and a connector plate 272 on the anchor strap 264 which is used to secure the assembly as described hereinabove. This structure provides a downward force toward the D-rings 268 pulling the top of the rear portion of the shoe snugly against the wearer's heel in the Achilles tendon area. After the straps pass through the D-rings 268, the forces are in the opposite direction permitting additional support across the variable instep opening.

Figure 17:
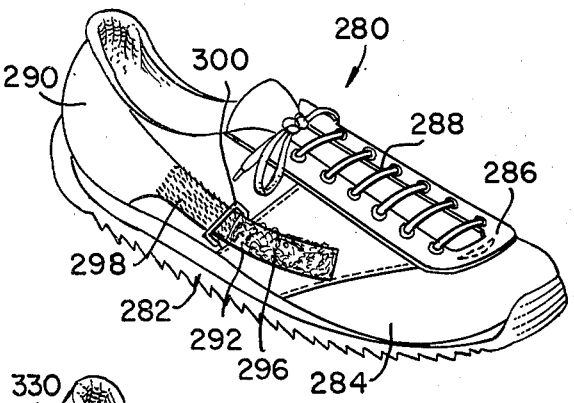
FIG. 17 is a perspective view of a tenth embodiment of the present invention.
Figure 18:
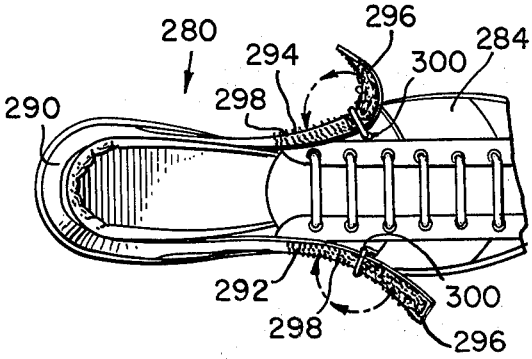
FIG. 18 is a partial plan view of FIG. 17.

FIG. 17 illustrates a shoe 280 having a sole 282, uppers 284, a U-throat vamp 286 forming a variable instep opening and laces 288. A heel restraint 290 covers the rear portion of the shoe 280 and with its lower portion secured at the point where the sole 282 and uppers 284 adjoin. The heel restraint 290 is elongated on each side of the shoe forming two fastener straps 292 and 294, as best seen in FIG. 18, both of which utilize Velcro-type hook and loop fastening means including a pad 296 of loop fastener material and a pad 298 of hook fastener material, respectively. Each fastener strap 292 and 294 cooperates with an anchor 300 formed by a D-ring secured to the shoe uppers 284.

With this arrangement, each side of the shoe may be independently adjusted until the exact desired tautness is achieved by passing one of the fastener straps through the anchor thereby exerting a force on the heel restraint 290 across the back portion of the shoe. When the precise desired tautness is achieved, the fastener straps 292 and 294 are folded back upon themselves and are secured using the coacting hook and loop fastener pads 296 and 298.

Figure 19:
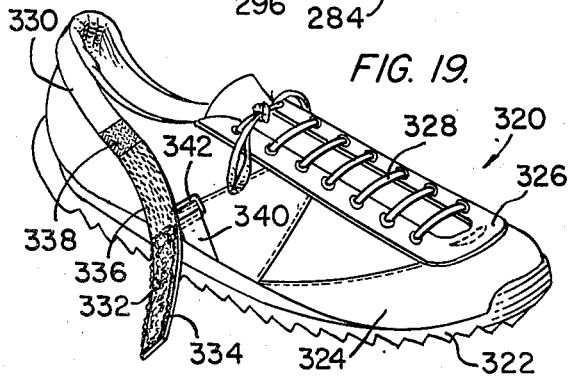
FIG. 19 is a perspective view of an eleventh embodiment of the present invention.
Figure 20:
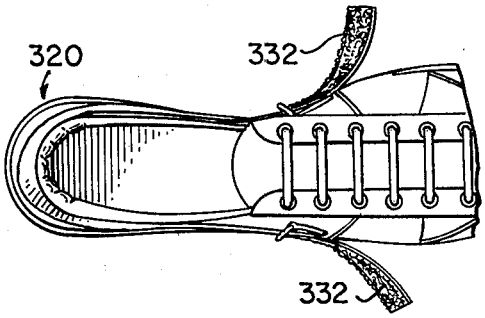
FIG. 20 is a partial plan view of FIG. 19.

FIGS. 19 and 20 illustrate a shoe 320 including a sole 322, uppers 324, a U-throat vamp 326 forming a variable instep opening and laces 328. A heel restraint 330 is formed of a strap attached to the extreme rear portion of the shoe 320 above the heel, the free ends forming fastener straps 332 utilizing Velcro-type hook and loop fastening means including a pad 334 of loop fastening material and a pad 336 of hook fastening material. Each fastener strap 332 includes a section 338 of elastic to provide additional flexibility. The fastener straps 332 cooperate with anchor straps 340 secured to the shoe at a point where the uppers 324 and sole 322 adjoin at a forward portion of the shoe. The anchor straps 340 include a D-ring 342 through which the free end of the fastener strap 332 is passed in order to secure the hook and loop closure assembly in the same manner as described hereinabove with reference to the other embodiments.

Figure 21:
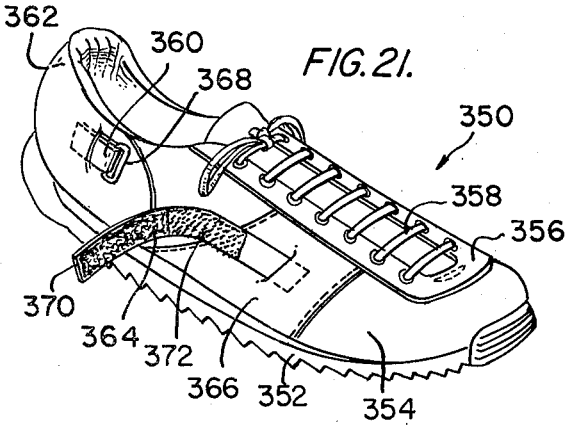
FIG. 21 is a perspective view of a twelfth embodiment of the present invention.
Figure 22:
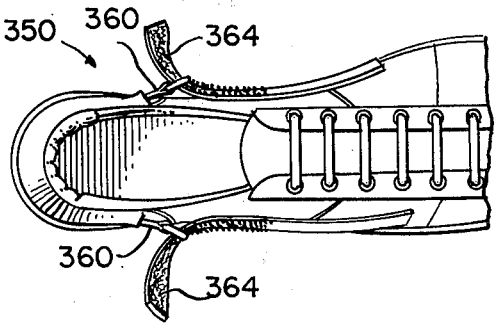
FIG. 22 is a partial plan view of FIG. 21.

FIGS. 21 and 22 show another running-type shoe 350 including a sole 352, uppers 354, a U-throat 356 forming a variable instep opening and laces 358. In this embodiment, the heel restraint is formed of an anchor strap 360 secured to the rear portion of the shoe adjacent the heel-counter cover 362 and a fastener strap 364 secured to the uppers 354 preferably in a reinforcing panel 366 secured to the shoe uppers 354. The anchor strap 360 includes a D-ring 368 adapted to receive the free end of the fastener strap 364. The fastener strap 364 utilizes a Velcro-type hook and loop fastening means including a pad 370 of loop fastening material and a pad 372 of hook fastening material.

The heel restraint arrangement is essentially the same on both sides of the shoe as seen in FIG. 22 so that independent control is provided on each side. In use, the fastener straps 364 are passed through the D-ring 368 and pulled until the precise desired tautness is achieved in the heel-counter area. The fastener straps 364 are folded back upon themselves to secure the coacting hook and loop fasteners.

Figure 23:
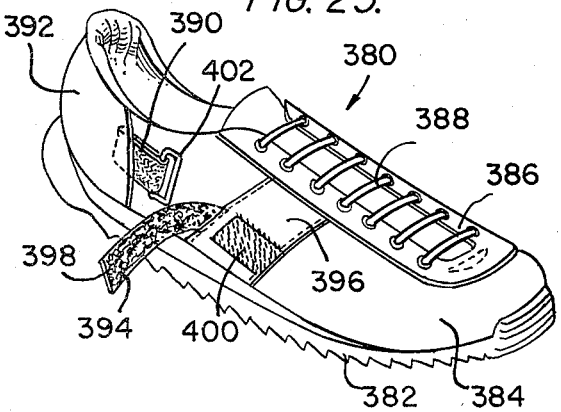
FIG. 23 is a perspective view of a thirteenth embodiment of the present invention.
Figure 24:
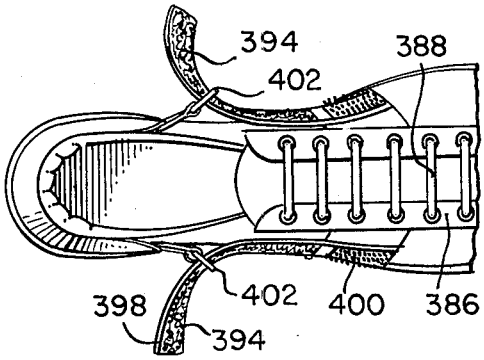
FIG. 24 is a partial plan view of FIG. 23.

FIGS. 23 and 24 show another embodiment of a running-type shoe 380 of the present invention including a sole 382, uppers 384, a U-throat vamp 386 and laces 388. The heel restraint is formed on each side of the shoe 380 and includes an anchor strap 390 made of elastic to provide additional flexibility and which is secured to the rear portion of the shoe at the edge of the heel-counter cover 392. Each side of the shoe is also provided with a fastener strap 394 secured to the edge of a reinforcement panel 396 in the shoe uppers 384. The fastener strap 394 includes a pad 398 of loop fastening material which coacts with a separate pad 400 of hook fastening material secured to the reinforcing panel 396 on the side of the shoe. Each anchor strap 390 includes a D-ring 402 through which the fastener strap 394 passes, as shown in FIG. 24, in order to provide a separate adjustable heel restraint on each side of the shoe. When the precise desired tautness is achieved, the heel restraint straps are secured using the coacting hook and loop fastening means.

Figure 25:
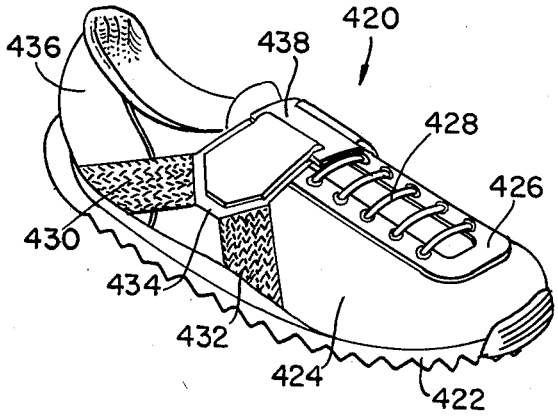
FIG. 25 is a perspective view of a fourteenth embodiment of the present invention.
Figure 26:
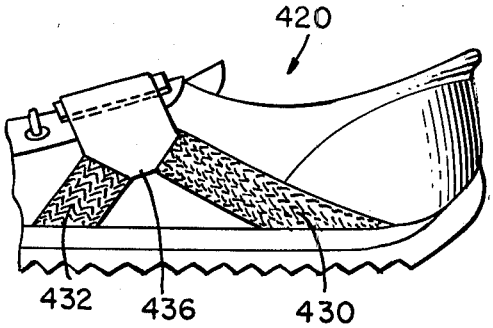
FIG. 26 is a partial side elevational view of FIG. 25.

FIGS. 25 and 26 show a shoe 420 of the present invention including a sole 422, uppers 424, U-throat vamp 426 forming a variable instep opening and laces 428. A Y-shaped heel restraint is provided on each side of the shoe 420 an is formed of two elastic legs 430 and 432. Leg 430 of the restraint overlays the rear portion of the shoe above the heel and is secured at a point where the sole 422 and heel-counter cover 436 adjoins. Leg 432 of the heel restraint overlays the shoe uppers 424 toward the front portion of the shoe 420 and is secured at a point where the sole 422 and uppers 424 adjoin. The two legs 430 and 432 are made with elastic material to provide additional flexibility. The heel restraint on one side of the shoe is formed by a fastener strap 434 utilizing Velcro-type hook and loop fastening means (not shown). The other side of the shoe includes an anchor strap 436 having an opening formed by a connector plate 438 which receives the free end of the fastener strap 434. Since the closure assembly is the same type as described with respect to the other embodiments hereinabove, the fastener strap 434 is passed through the opening in the connector plate 438 and secured back upon itself using the Velcro-type hook and loop fastening means.

Figure 27:
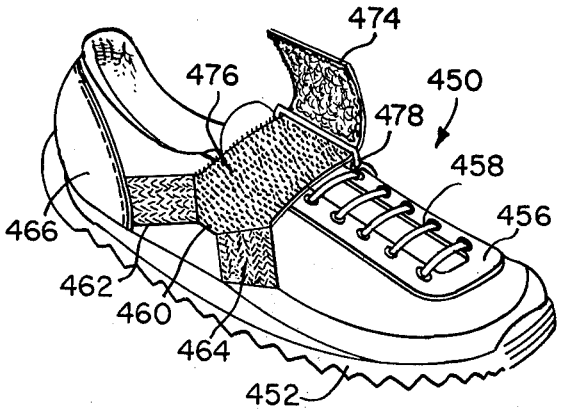
FIG. 27 is a perspective view of a fifteenth embodiment of the present invention.
Figure 28:
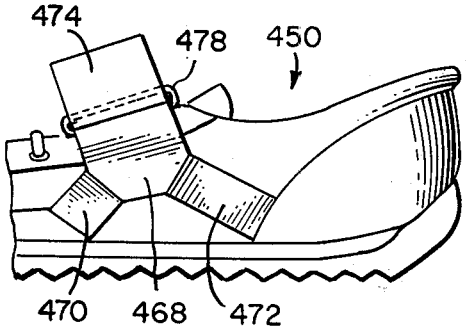
FIG. 28 is a partial side elevational view of FIG. 27.

FIGS. 27 and 28 show a shoe 450 including a sole 452, uppers 454, U-throat vamp 456 and laces 458. The restraint is formed of a Y-shaped fastener strap 460 including legs 462 and 464 of elastic. Leg 462 is connected adjacent the edge of a heel-counter cover 466 at the rear portion of the shoe. Leg 464 is secured to the shoe uppers 454 toward the front of the shoe 450. An anchor strap 468 is provided on the opposite side of the shoe and also includes Y-shaped legs 470 and 472 secured in the same manner as the legs 462 and 464. The fastener strap 460 utilizes Velcro-type hook and loop fastening means including a pad 474 of loop fastening material and a pad 476 of hook fastening material. The anchor strap 468 includes a D-ring 478 adapted to receive the free end of the fastener strap 474 to secure the closure in the same manner as described hereinabove.

Figure 29:
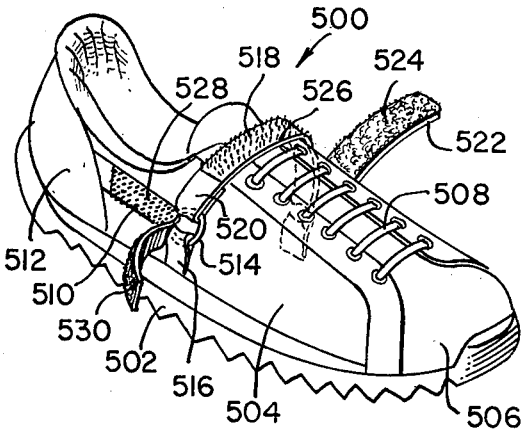
FIG. 29 is a perspective view of a sixteenth embodiment of the present invention.
Figure 30:
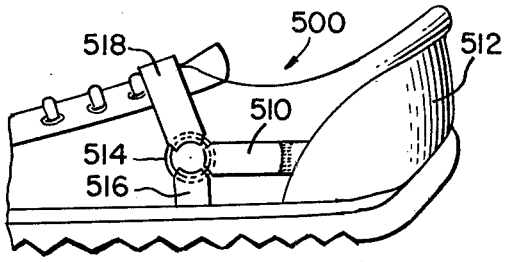
FIG. 30 is a partial side elevational view of FIG. 29.
Figure 31:
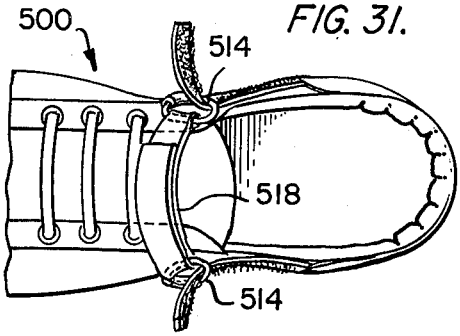
FIG. 31 is a partial plan view of FIG. 29.

FIGS. 29, 30 and 31 show a blucher-type running shoe 500 having a sole 502, quarters 504, a vamp 506 and laces 508. The heel restraint is formed of a plurality of straps and anchor means as follows. Fastener straps 510 on each side of the shoe 500 are secured to the rear portion of the shoe preferably adjacent the edge of a heel-counter cover 512. The fastener strap 510 passes through and is engaged by an anchor means on each side of the shoe formed of an O-ring 514 and anchor strap 516 secured at a point where the shoe uppers 504 and sole 502 adjoin. A spanning strap 518 includes a fixed end 520 secured to an O-ring 514 on one side of the shoe and a free end 522 adapted to span the variable instep opening and be inserted into the O-ring 514 on the opposite side of the shoe. The spanning strap 518 utilizes Velcro-type hook and loop fastening means including a pad 524 of loop fastening material and a pad 526 of hook fastening material. As shown in FIGS. 30 and 31, the spanning strap 518 is secured between the O-rings 514 by folding it back upon itself to secure the coacting hook and loop fastener pads 524 and 526. Each fastener strap 510 also utilizes Velcro-type hook and loop fastening means including a pad of hook fastening material 528 and a pad of loop fastening material 530 on each side of the shoe. Similarly, the fastener straps are passed through the O-ring 514 and folded back upon itself to secure the hook and loop fastening means when the precise desired tautness is obtained on the heel portion of the shoe 500.

Various parts shown in the embodiments are interchangeable and it will be appreciated many modifications may be made in the present invention without departing from the scope of the following claims, for example, any suitable separate fastener including first and second fastening members having complementary, coacting, flexible gripping elements may be used in place of the hook and loop fastening means specifically described in the specification.

What is claimed is:

1. A shoe having a sole, uppers and a variable opening, the improvement including a heel counter adjacent the rear portion of said uppers, said heel counter formed with at least one adjustable and flexible closure assembly located adjacent the rear and side portions of said uppers forming a heel restraint, said closure assembly comprising:

a flexible, multi-adjustable, separable fastener means having first and second fastening members including arrays of complementary, coating flexible gripping elements for securing said closure assembly;

a fastener strap having a fixed portion and a free end, said free end including said first fastening member, said second fastening member positioned adjacent said fixed portion of said fastener strap; and anchor means having a fixed portion and a free end, said free end having an opening through which the free end of said fastener strap passes, permitting adjustment to maintain a precise desired tautness of said closure assembly to fasten said shoe.

2. The shoe of claim 1 wherein said closure assembly is formed as an integral part of said heel counter.

3. The shoe of claim 2 wherein said fastener strap is formed as an elongated extension of said heel counter on one side of said shoe, and said anchor means is formed as a second elongated extension of said heel counter on the opposite side of said shoe.

4. The shoe of claim 1 wherein said heel counter is attached to said shoe at the point where said sole and uppers join, the remaining portion of said heel counter adapted to lie adjacent the uppers of said shoe.

5. The shoe of claim 4 wherein said heel counter extends from the rearward part of said shoe to a point approximately midway between the toe and heel of said shoe.

6. The shoe of claim 1 wherein said rear portion of said shoe further includes a heel-counter cover and said restraint includes straps attached to each side of said shoe adjacent the edge of said heel-counter cover, said restraint straps forming said fastener strap and said anchor means.

7. The shoe of claim 1 wherein said anchor opening is formed of a D-ring.

8. The shoe of claim 1 wherein said anchor opening is formed of a grommet.

9. The shoe of claim 1 wherein said anchor opening is formed of a connector plate.

10. The shoe of claim 1 wherein said restraint further includes stabilizer straps formed on each of said elongated free portions.

11. The shoe of claim 8 wherein said stabilizer straps are attached to said uppers at a forward portion of said shoe.

12. The shoe of claim 1 wherein said restraint includes straps and said uppers include guide loops to retain said restraint straps.

13. The shoe of claim 12 wherein said guide loops are formed of D-rings attached to said uppers.

14. The shoe of claim 1 wherein said restraint is formed of straps attached to said rear portion of said uppers and extending forwardly on each side of said shoe, said restraint further including D-rings attached where said uppers and sole adjoin and adapted to receive said restraint straps and change the direction thereof whereby said straps produce a downward force between said rear portion to said D-rings and said strap produces an upward force between said D-rings to said variable opening.

15. The shoe of claim 1 wherein said restraint is formed of straps on each side of said shoe producing a downward force between said rear portion and said sole and an upward force between said sole and said variable opening.

16. The shoe of claim 1 wherein said restraint forms a member surrounding said rear portion of said shoe at the heel-counter area, said restraint being attached to said shoe at the junction of said sole and uppers and having an elongated free portion on each side of said shoe forming a fastener strap on each of said shoe sides and said anchor means is attached to said uppers adjacent said fastener straps.

17. The shoe of claim 1 wherein said restraint forms straps attached to said rear portion and extend forwardly on said shoe forming a fastener strap on each side of said shoe and said anchor means is secured adjacent said sole forward of said rear portion of said shoe.

18. The shoe of claim 1 including fastener straps on each side of said shoe having a fixed end secured to said uppers on said shoe forward of said rear portion, said straps having a free end positioned rearwardly of said shoe and said anchor means includes anchor straps on each side of said shoe.

19. The shoe of claim 18 wherein said anchor straps are attached at the heel-counter area of said shoe.

20. The shoe of claim 1 wherein said fastener strap includes a section of elastic.

21. The shoe of claim 1 wherein said anchor means forms a strap including a section of elastic.

22. The shoe of claim 1 wherein said uppers include a reinforcement panel and said fastener strap is connected adjacent the edge of said reinforcement panel and said uppers.

23. The shoe of claim 22 wherein said rear portion of said uppers includes a heel-counter cover and said anchor means is attached adjacent the edge of said cover.

24. The shoe of claim 1 wherein said fastener strap utilizes elasticized hook and loop fastening material.

25. The shoe of claim 1 wherein said restraint forms a Y-shaped strap on each side of said rear portion of said shoe, said strap including one leg attached rearwardly on said shoe and overlaying said rear portion and another leg positioned forwardly on said shoe to stabilize said straps.

26. The shoe of claim 25 wherein one of said Y-shapes straps forms said fastener strap and a second of said Y-shaped straps forms said anchor means.

27. The shoe of claim 25 wherein said legs are made of elastic material.

28. The shoe of claim 25 wherein said legs are connected above said sole on said uppers.

29. The shoe of claim 1 wherein said heel restraint comprises a fastener straps on each side of said shoe, said fastener straps attached to said rear portion, anchor straps on each side of said shoe attached adjacent said sole forward of said rear portion of said shoe and said anchor straps including O-rings for securing said fastener straps, and a spanning strap adapted to be connected between said O-rings across said variable opening.

30. The shoe of claim 1 wherein said fastener straps and said spanning strap each utilize coacting hook and loop fastening means to secure the straps.

31. The shoe of claim 1 wherein said arrays of complementary, coacting, flexible gripping elements include an array of hook type gripping elements on said first fastening member, and an array of loop type gripping elements on said second fastening member.

* * * * *